US005709226A

United States Patent [19]

Draghetti

[11] Patent Number: 5,709,226

[45] Date of Patent: Jan. 20, 1998

[54] ROLLING UNIT FOR PRODUCING FILTER-TIPPED CIGARETTES

[75] Inventor: Fiorenzo Draghetti, Medicina, Italy

[73] Assignee: G.D Societa' per Azioni, Bologna, Italy

[21] Appl. No.: 587,509

[22] Filed: Jan. 17, 1996

[30] Foreign Application Priority Data

Jan. 17, 1995 [IT] Italy ..... BO95A0009

[51] Int. Cl.[6] ..... A24C 5/50

[52] U.S. Cl. ..... 131/94; 131/93; 131/29; 131/34

[58] Field of Search ..... 131/94, 93, 29, 131/34

[56] References Cited

U.S. PATENT DOCUMENTS

| | | | |
|---|---|---|---|
| 3,348,552 | 10/1967 | McCarthy et al. | 131/94 |
| 4,149,546 | 4/1979 | Luke et al. | 131/94 |
| 5,520,195 | 5/1996 | Rizzoli et al. | 131/94 |

FOREIGN PATENT DOCUMENTS

| | | | |
|---|---|---|---|
| 0 599 162 A1 | 6/1994 | European Pat. Off. | 131/94 |
| 1 125 827 | 3/1962 | Germany | 131/94 |
| 1 251 662 | 10/1971 | United Kingdom | 131/94 |
| 2 205 477 A | 12/1988 | United Kingdom | 131/94 |

*Primary Examiner*—V. Millin
*Assistant Examiner*—Charles W. Anderson
*Attorney, Agent, or Firm*—Marshall, O'Toole, Gerstein, Murray & Borun

[57] ABSTRACT

A unit for rolling tobacco items, wherein a conveyor device presents a number of peripheral suction seats, each for receiving and feeding an item, formed of at least one cigarette portion and a respective filter, in a direction crosswise to the longitudinal axis of the item; each seat being defined by a pair of rollers for rotating each item about its longitudinal axis to connect the cigarette portion and respective filter integral with each other by means of a respective adhesive strip and so form a respective cigarette.

6 Claims, 1 Drawing Sheet

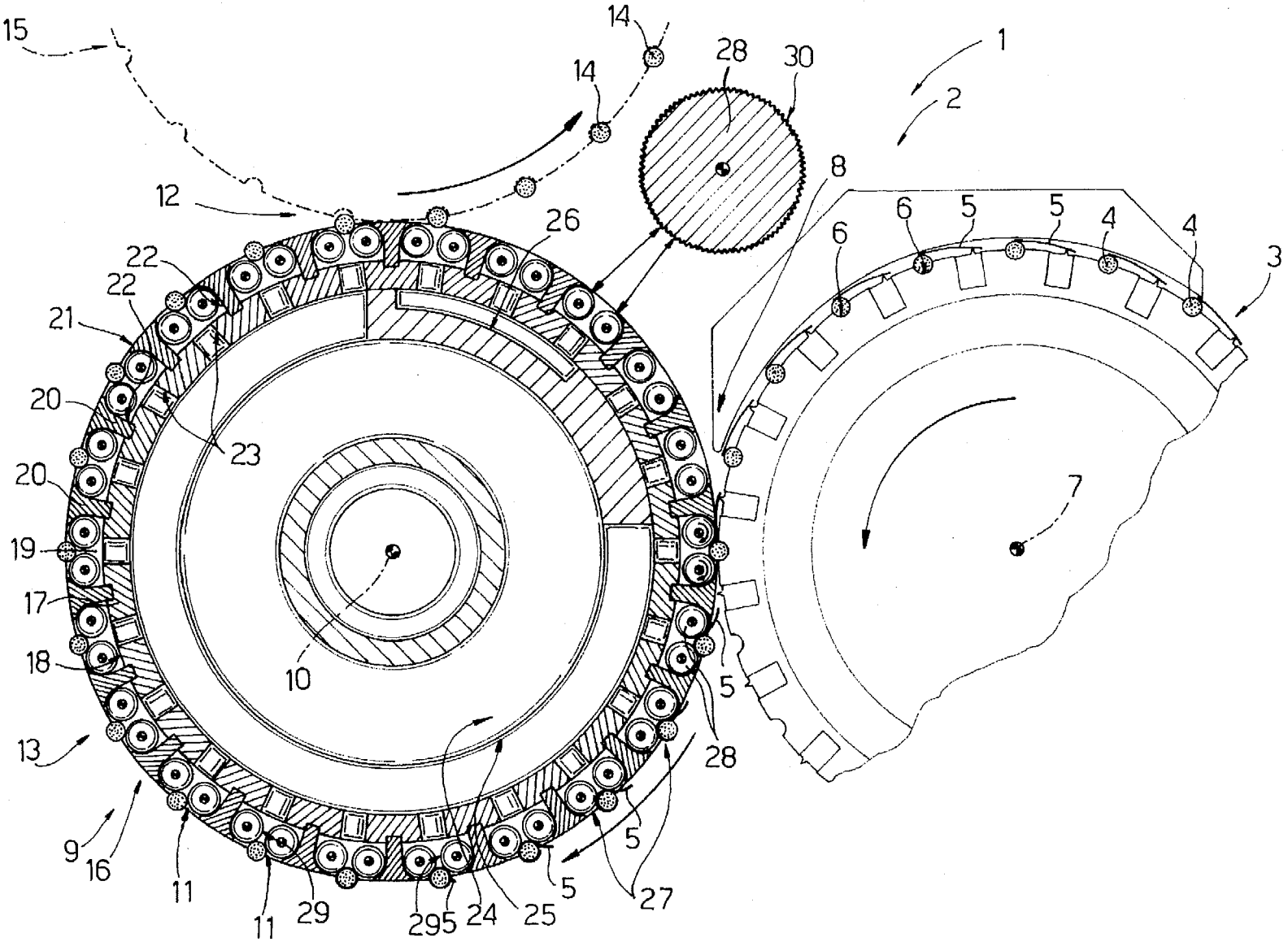
1
2
3
4
4
5
5
6
6
7
8
9
10
11
11
12
13
14
14
15
16
17
18
19
20
20
21
22
22
23
24
25
26
27
28
28
29
29
30

ROLLING UNIT FOR PRODUCING FILTER-TIPPED CIGARETTES

BACKGROUND OF THE INVENTION

The present invention relates to a rolling unit for producing filter-tipped cigarettes.

More specifically, the present invention relates to a rolling unit for connecting a cigarette portion and a filter by means of a connecting strip, which is rolled about the facing ends of the cigarette portion and filter.

Known rolling units of the above type normally comprise a conveyor roller, which is rotated about its axis at constant speed, and presents a number of peripheral seats equally spaced about the outer surface of the roller, and each of which receives and retains a respective item—comprising a cigarette portion and a coaxial filter with their respective ends contacting each other—together with an adhesive strip connected in projecting manner to the item itself. Known units normally also comprise a fixed plate facing the outer periphery of the conveyor roller with which it defines a rolling channel of a width approximately equal to but no greater than the diameter of the cigarette portions and respective filters, and extending parallel to the outer periphery of the roller and about an arc of such a length as to permit at least one complete turn of each item about its axis.

A major drawback of known rolling units of the above type is that the rolling speed, i.e. the speed at which the items are rolled about their axis, depends on the speed at which the items are conveyed by the conveyor roller. Consequently, high output speeds correspond to high conveying speeds and, hence, high rolling speeds, which inevitably result in tobacco fallout if not actual tearing of the cigarettes.

SUMMARY OF THE INVENTION

It is an object of the present invention to provide a rolling unit wherein the rolling speed, while inevitably related to the output speed of the cigarette manufacturing machine, is not a direct function of it.

According to the present invention, there is provided a rolling unit for producing filter-tipped cigarettes; the unit comprising an input conveyor, an intermediate conveyor and an output conveyor; the intermediate conveyor being tangent to the input and output conveyors at a first and second transfer station respectively; the input conveyor supplying the first transfer station with a succession of items, each comprising at least one cigarette portion and at least one coaxial filter with their respective ends contacting each other, and a distended adhesive strip connected to the outer periphery of the item and astride said cigarette portion and said filter; the output conveyor receiving from the intermediate conveyor at least one succession of filter-tipped cigarettes; and the intermediate conveyor being a rolling conveyor presenting a number of suction seats, each for receiving and retaining a said item and feeding it in a direction crosswise to the longitudinal axis of the item; characterized in that each said seat is defined by rolling means movable with said intermediate conveyor and revolving in relation to the intermediate conveyor to rotate each item about said longitudinal axis; retaining means being provided to maintain each said item contacting the respective rolling means.

According to a preferred embodiment of the above rolling unit, said rolling means comprise, for each said seat, a pair of rollers parallel to each other and crosswise to said direction; the rollers in each said pair being cylindrical rollers, preferably presenting rough outer surfaces, rotating in the same direction, and defining a respective said seat.

The rolling unit preferably also comprises means for supporting said strips, and which are fitted to the intermediate conveyor and interposed between adjacent pairs of rollers.

BRIEF DESCRIPTION OF THE DRAWING

The present invention will be described with reference to the accompanying drawing, which shows a schematic cross section, with parts removed for clarity, of a non-limiting embodiment.

DETAILED DESCRIPTION OF THIS INVENTION

Number 1 in the accompanying drawing indicates a filter assembly machine presenting a rolling unit 2 in turn comprising a known input roller 3 on which are retained pneumatically a number of items 4 comprising at least one cigarette portion and a respective filter, and each presenting on its outer periphery a projecting adhesive connecting strip 5. The cigarette portions and respective filters are arranged coaxially, with their respective ends contacting each other, inside respective seats 6 parallel to the generating lines of roller 3, which rotates anticlockwise (in the drawing) about a substantially horizontal axis 7 perpendicular to the plane of the drawing, and feeds items 4, crosswise to their respective axes, to a transfer station 8.

Unit 2 also comprises a rotary, substantially cylindrical conveyor 9 mounted to rotate clockwise (in the drawing) about an axis 10 parallel to axis 7, and the outer periphery of which is tangent to roller 3 at station 8. Conveyor 9 presents a number of equally spaced, peripheral suction seats 11, each of which provides for receiving and retaining a respective item 4 and for feeding it from station 8 to an unloading station 12 located downstream from station 8 in the rotation direction of conveyor 9, and defining, on conveyor 9, a rolling arc 13 extending from station 8 to station 12. As explained in more detail later on, as it is fed along arc 13 by conveyor 9, each item 4 is rotated about its longitudinal axis to wind strip 5 about the facing ends of the cigarette portion and respective filter to form a respective filter-tipped cigarette 14.

Unit 2 also comprises an output roller 15 tangent to conveyor 9 at station 12, mounted to rotate anticlockwise (in the drawing) about its axis parallel to axis 10, and which provides for successively receiving cigarettes 14 from conveyor 9.

Conveyor 9 comprises a powered drum 16 in turn comprising a tubular body 17 coaxial with axis 10 and defined externally by a cylindrical surface 18. Tubular body 17 presents two annular end flanges 19 (only one shown) extending outwards from surface 18 and connected to each other by a number of longitudinal, radial partitions 20, the inner end of which is connected integral with tubular body 17, and the outer end of which is substantially mushroom-shaped and is defined externally by a portion of a cylindrical surface 21 coaxial with axis 10. Together with surface 18 and the two flanges 19, each pair of adjacent partitions 20 define an outwardly open chamber 22 communicating inwards with a hole 23 formed through tubular body 17 and connecting chamber 22 to a known pneumatic distributor 24 fixed inside tubular body 17. More specifically, distributor 24 presents a suction chamber 25 extending along the whole of arc 13; and a further chamber 26 extending from station 12 towards station 8 in the rotation direction of drum 16, and longer than the distance between two adjacent holes 23.

Each chamber 22 houses a rolling device 27 connected to tubular body 17 so as to be rotated by body 17 about axis 10, and which comprises a pair of rollers 28 supported at opposite ends by flanges 19, and powered in known manner (not shown) so as to rotate in the same direction, and more specifically clockwise in the accompanying drawing. Rollers 28 are separated by a distance approximately equal to but no greater than the diameter of item 4, and define a respective seat 11 communicating with respective chamber 22 and respective hole 23 via an opening 29 between the two rollers 28.

Each roller 28 is defined externally by a rough cylindrical surface 30, preferably an axially knurled surface, substantially tangent to surface 21.

In actual use, items 4 are transferred successively from roller 3 to rotary conveyor 9 at transfer station 8, and are withdrawn by suction by a respective seat 11 located in station 8. In addition to permitting each item 4 to be withdrawn from roller 3, the vacuum formed by distributor 24 inside each chamber 22 along arc 13 ensures that each item 4, once positioned so as to close opening 29 in respective seat 11, is positioned with its outer surface contacting the outer surfaces 30 of rollers 28 of respective rolling device 27, and with respective strip 5 contacting and resting along surface 21 of a respective partition 20.

The instant each item 4 contacts surfaces 30, it is rolled by rollers 28 so that, along a given portion of rolling arc 13, strip 5 is wound to form a respective cigarette 14.

Consequently, though the rolling time of each item 4 is at most equal to the time taken by respective seat 11 to travel along rolling arc 13, and as such is still a function of the operating speed of machine 1, the speed at which each item 4 is rotated about its axis is many times less than that at which it is rotated by a known rolling unit, by virtue of the rolling tools, comprising rollers 28, of rolling devices 27 not being fixed, but moving with item 4 and rotating at a speed substantially independent of that of drum 16.

I claim:

1. A rolling unit (2) for producing filter-tipped cigarettes (14); the unit comprising an input conveyor (3), an intermediate conveyor (9) and an output conveyor (15); the intermediate conveyor (9) being tangent to the input and output conveyors (3, 15) at a first (8) and second (12) transfer station respectively; the input conveyor (3) supplying the first transfer station (8) with a succession of items (4), each comprising at least one cigarette portion and at least one coaxial filter with their respective ends contacting each other, and a distended adhesive strip (5) connected to the outer periphery of the item (4) and astride said cigarette portion and said filter; the output conveyor (15) being adapted to receive from the intermediate conveyor (9) at least one succession of filter-tipped cigarettes (14); the intermediate conveyor (9) being a rolling conveyor having a number of suction seats (11), each for receiving and retaining a said item (4) and feeding said item crosswise; and each said seat (11) being defined by rolling means (27) movable with said intermediate conveyor (9) and revolving in relation to the intermediate conveyor (9) to rotate each item (4) about a longitudinal axis thereof; said rolling means (27) comprising, for each said seat (11), a pair of motorized rollers (28) parallel to each other and defining a respective said seat (11); suction retaining means (25) being provided between said two motorized rollers (28 to maintain each said item (4) contacting the respective rolling means (27) such that the items (4) are rolled at a speed independent of the peripheral speed of said intermediate conveyor (9).

2. A unit as claimed in claim 1, wherein said rollers (28) in each said pair are cylindrical rollers (28) rotating in a same direction.

3. A unit as claimed in claim 2, wherein said rollers (28) in each said pair have rough outer surfaces (30).

4. A unit as claimed in claim 2, further comprising supporting means (20) for supporting said strips (5), said supporting means (20) being fitted to the intermediate conveyor (9) and interposed between adjacent said pairs of rollers (28).

5. A unit as claimed in claim 4, wherein said intermediate conveyor (9) comprises a cylindrical drum (16) including a number of longitudinal peripheral chambers (22), each housing a said pair of rollers (28); and each chamber (22) communicating with said suction retaining means (25) along a rolling arc (13) extending between said transfer stations (8, 12).

6. A unit as claimed in claim 5, wherein said supporting means (20) comprise a number of radial, longitudinal partitions (20) extending outwards from said drum (16); each said chamber (22) being defined laterally by a respective pair of adjacent said partitions (20).

* * * * *